US011270617B2

(12) United States Patent
Yin et al.

(10) Patent No.: US 11,270,617 B2
(45) Date of Patent: Mar. 8, 2022

(54) DRIVE CIRCUIT FOR DISPLAY PANEL, AND DRIVE METHOD AND DISPLAY PANEL THEREOF

(71) Applicant: BOE TECHNOLOGY GROUP CO., LTD., Beijing (CN)

(72) Inventors: Xinshe Yin, Beijing (CN); Tian Dong, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/051,584

(22) PCT Filed: Mar. 23, 2020

(86) PCT No.: PCT/CN2020/080628

§ 371 (c)(1),
(2) Date: Oct. 29, 2020

(87) PCT Pub. No.: WO2020/192619

PCT Pub. Date: Oct. 1, 2020

(65) Prior Publication Data

US 2021/0233450 A1 Jul. 29, 2021

(30) Foreign Application Priority Data

Mar. 25, 2019 (CN) ..... 201910227807.1

(51) Int. Cl.
*G09G 3/20* (2006.01)

(52) U.S. Cl.
CPC ..... *G09G 3/20* (2013.01); *G09G 2300/08* (2013.01); *G09G 2310/027* (2013.01);
(Continued)

(58) Field of Classification Search
None
See application file for complete search history.

(56) References Cited

U.S. PATENT DOCUMENTS 5,426,447 A * 6/1995 Lee ..... G09G 3/3688 345/103
5,892,493 A * 4/1999 Enami ..... G09G 3/3688 345/94

(Continued)

FOREIGN PATENT DOCUMENTS

CN 1886772 A 12/2006
CN 101051125 A 10/2007

(Continued)

OTHER PUBLICATIONS

International Search Report and Written Opinion for International Application No. PCT/CN2020/080628 dated Jun. 28, 2020.

(Continued)

*Primary Examiner* — Dorothy Harris
(74) *Attorney, Agent, or Firm* — Thomas | Horstemeyer, LLP

(57) ABSTRACT

A driving circuit for a display panel is disclosed, where the display panel comprises data lines. The driving circuit for the display panel includes a share line coupled to the data lines; a power supply circuit connected to the share line, and configured to provide a share voltage to the share line; and switch units coupled to the data lines, where each of the switch units has a first end coupled to the share line and a second end coupled to a corresponding one of the data lines, and the switch units are configured to, in a share phase, connect the data lines and transmit the share voltage on the share line to the data lines in response to a control signal. The display panel drive circuit can reduce the power consumption of a source drive circuit of the display panel.

15 Claims, 4 Drawing Sheets

(52) U.S. Cl.
CPC . *G09G 2310/0291* (2013.01); *G09G 2310/08* (2013.01); *G09G 2330/021* (2013.01)

(56) References Cited

U.S. PATENT DOCUMENTS 6,307,681 B1 * 10/2001 Aoki ..... G09G 3/3648 340/14.1
6,850,218 B2 * 2/2005 Waterman ..... G09G 3/3688 345/103
6,924,784 B1 * 8/2005 Yeo ..... G09G 3/3688 345/98
7,898,507 B2 * 3/2011 Takei ..... G09G 3/325 345/76
9,311,858 B2 4/2016 Cho et al.
2002/0047820 A1 * 4/2002 Ha ..... G09G 3/3648 345/87
2003/0030602 A1 * 2/2003 Kasai ..... G09G 3/3275 345/76
2003/0038760 A1 * 2/2003 Kim ..... G09G 3/3283 345/76
2003/0214470 A1 * 11/2003 Sun ..... G09G 3/3655 345/87
2004/0051688 A1 * 3/2004 Orii ..... G09G 3/3648 345/87
2005/0116747 A1 * 6/2005 Shimoda ..... G09G 3/3283 327/108
2005/0243034 A1 * 11/2005 Chung ..... G09G 3/3225 345/76
2006/0038800 A1 * 2/2006 Tokioka ..... G09G 3/3283 345/204
2006/0232539 A1 * 10/2006 Hashimoto ..... G09G 3/3688 345/96
2008/0266277 A1 10/2008 Ichikura et al.
2009/0051634 A1 * 2/2009 Chen ..... G09G 3/3648 345/87
2011/0102410 A1 5/2011 Cho et al.
2013/0083001 A1 * 4/2013 Jeong ..... G09G 3/3266 345/212
2018/0012556 A1 1/2018 Hsu et al.
2018/0308414 A1 10/2018 Kang et al.

FOREIGN PATENT DOCUMENTS

| | | | |
|---|---|---|---|
| CN | 101109858 | A | 1/2008 |
| CN | 101320539 | A | 12/2008 |
| CN | 100485472 | C | 5/2009 |
| CN | 101620841 | A | 1/2010 |
| CN | 102054431 | A | 5/2011 |
| CN | 103000119 | A | 3/2013 |
| CN | 105976747 | A | 9/2016 |
| CN | 106098018 | A | 11/2016 |
| CN | 108648694 | A | 10/2018 |
| CN | 108735138 | A | 11/2018 |
| CN | 109801585 | A | 5/2019 |
| CN | 105976747 | B | 11/2019 |
| JP | 2008096651 | A | 4/2008 |
| JP | 2008275733 | A | 11/2008 |

OTHER PUBLICATIONS

First Office Action at CN Patent Application No. 201910227807.1 dated Feb. 2, 2021.

* cited by examiner

DRIVE CIRCUIT FOR DISPLAY PANEL, AND DRIVE METHOD AND DISPLAY PANEL THEREOF

CROSS-REFERENCE TO RELATED APPLICATIONS

The present application is a 35 U.S.C. § 371 national phase application of International Application No. PCT/CN2020/080628, filed on Mar. 23, 2020, which is based upon and claims priority to Chinese Patent Application No. 201910227807.1, filed on Mar. 25, 2019, and titled "DISPLAY PANEL DRIVE CIRCUIT AND DRIVE METHOD, AND DISPLAY PANEL," the entire contents of which are incorporated herein by reference.

TECHNICAL FIELD

The present disclosure relates to display technology and, more particularly, to a driving circuit for a display panel, a driving method for a display panel, and a display panel using the same.

BACKGROUND

A display panel generally includes a plurality of sub-pixel units distributed in an array, and each of the sub-pixel units can emit light of a specific color, so as to realize the display of the display panel.

In the related art, a display panel generally includes a plurality of data lines extending in a column direction, a plurality of scan lines extending in a row direction, a source driving circuit, and a gate driving circuit. Each of the data lines is connected to a plurality of sub-pixel units, the source driving circuit can transmit data signals to the plurality of data lines, the data signals may be configured to drive the sub-pixel units, and the gate driving circuit can send scan signals to the sub-pixel units row by row through the scan lines to realize the row-by-row driving of the sub-pixel units.

It should be noted that information disclosed in this part are provided only for acquiring a better understanding of the background of the present disclosure and therefore may include information that is not prior technology already known to those of ordinary skill in the art.

SUMMARY

An object of the present disclosure is to provide a driving circuit for a display panel, a driving method for a display panel, and a display panel using the same. The driving circuit for a display panel is used to solve the problem of high power consumption of the source driving circuit.

Other characteristics and advantages of the present disclosure will become apparent by the following detailed description, or partly be learned by practice of the invention.

According to an aspect of the present disclosure, there is provided a driving circuit for a display panel, wherein the display panel comprises a plurality of data lines, and the driving circuit for the display panel comprises: a share line coupled to the plurality of data lines; a power supply circuit connected to the share line, and configured to provide a share voltage to the share line; and a plurality of switch units coupled to the plurality of data lines, wherein each of the switch units has a first end coupled to the share line and a second end coupled to the corresponding data lines, and the plurality of switch units are configured to, in a share phase, connect the plurality of data lines and transmit the share voltage on the share line to the data lines in response to a control signal.

In an exemplary embodiment of the present disclosure, the driving circuit for the display panel further comprises at least one share capacitor connected between the share line and a reference voltage end.

In an exemplary embodiment of the present disclosure, a number of the at least one share capacitor is two, and the share capacitors are a first capacitor and a second capacitor, wherein, if the plurality of data lines comprise a total of N data lines arranged side by side along a direction of the share line, the first share capacitor is provided at a coupling position of the share line and the first data line, and a second share capacitor is provided at a coupling position of the share line and the N-th data line.

In an exemplary embodiment of the present disclosure, the driving circuit for the display panel further comprises: a timing controller, wherein the power supply circuit comprises: an averaging sub-circuit coupled to the timing controller, and configured to receive a plurality of initial data signals output by the timing controller, for driving sub-pixel units in a same row, to obtain an average data signal according to the plurality of initial data signals; a digital-to-analog converter coupled to the averaging sub-circuit, and configured to convert the average data signal into an average analog voltage; and an amplifier coupled to the digital-to-analog converter, and configured to amplify the average analog voltage into the share voltage, wherein the average data signal is equal to an average of the plurality of initial data signals, and the share voltage is equal to an average of driving voltages corresponding to the sub-pixel units in the same row.

In an exemplary embodiment of the present disclosure, each of the plurality of switch units is a switch transistor, and the switch transistor has a first end coupled to the share line, a second end coupled to a corresponding one of the data lines, and a control end configured to receive the control signal.

In an exemplary embodiment of the present disclosure, the driving circuit for the display panel further comprises: a timing controller and a source driving circuit, wherein the control signal is controlled by the timing controller according to an output timing of the source driving circuit.

In an exemplary embodiment of the present disclosure, the driving circuit for the display panel further comprises: a timing controller and a source driving circuit, wherein the share line and the switch unit are placed inside the source driving circuit, and the control signal is generated by the source driving circuit under a control of the timing controller.

According to an aspect of the present disclosure, there is provided a driving method for a display panel, which is used for driving the above-described driving circuit for the display panel, comprising:

providing the share voltage to the share line with the power supply circuit; and in the share phase, turning on the plurality of switch units to connect the plurality of data lines and transmitting the share voltage on the share line to the data lines.

In an exemplary embodiment of the present disclosure, the share voltage is equal to an average of driving voltage corresponding to the sub-pixel units in the same row.

According to an aspect of the present disclosure, there is provided a display panel comprising the above-mentioned driving circuit for a display panel.

The present disclosure provides a driving circuit and driving method for a display panel, and a display panel. The display panel includes a plurality of data lines, and the driving circuit for the display panel further includes: a share line, a power supply circuit, and a plurality of switch units. The share line is coupled to the plurality of data lines. The power supply circuit is connected to the share line and is configured to provide a share voltage to the share line. The plurality of switch units are coupled to the plurality of data lines, wherein each of the switch units has a first end coupled to the share line, and a second end coupled to the corresponding data line, and the plurality of switch units are configured to, in a share phase, connect the plurality of data lines and transmit the share voltage on the share line to the data lines in response to a control signal. The driving circuit for the display panel provided by the present disclosure connects the plurality of data lines in the share phase to neutralize charges on the data lines to an average voltage, and transmits the share voltage to the data lines through the share line as well, and the share voltage can reduce voltage variation amplitudes of the data lines in a driving phase. On one hand, the driving circuit for the display panel can not only reduce power consumption of the source driving circuit but also reduce time taken for charging the sub-pixel units by the source driving circuit. On the other hand, the present disclosure neutralizes the charges among the data lines by connecting the plurality of data lines in the share phase, thus preventing the share line from inputting charges to each of the data lines to make its voltage reach a preset voltage, thereby reducing the power consumption of the power supply circuit.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute part of this specification, illustrate embodiments consistent with the invention and, together with the description, serve to explain the principles of the invention. Understandably, the drawings in the following description are only for illustrating some embodiments of the present disclosure and those of ordinary skill in the art can also derive other drawings based on the drawings without paying any creative labor.

DETAILED DESCRIPTION

Figure 1:
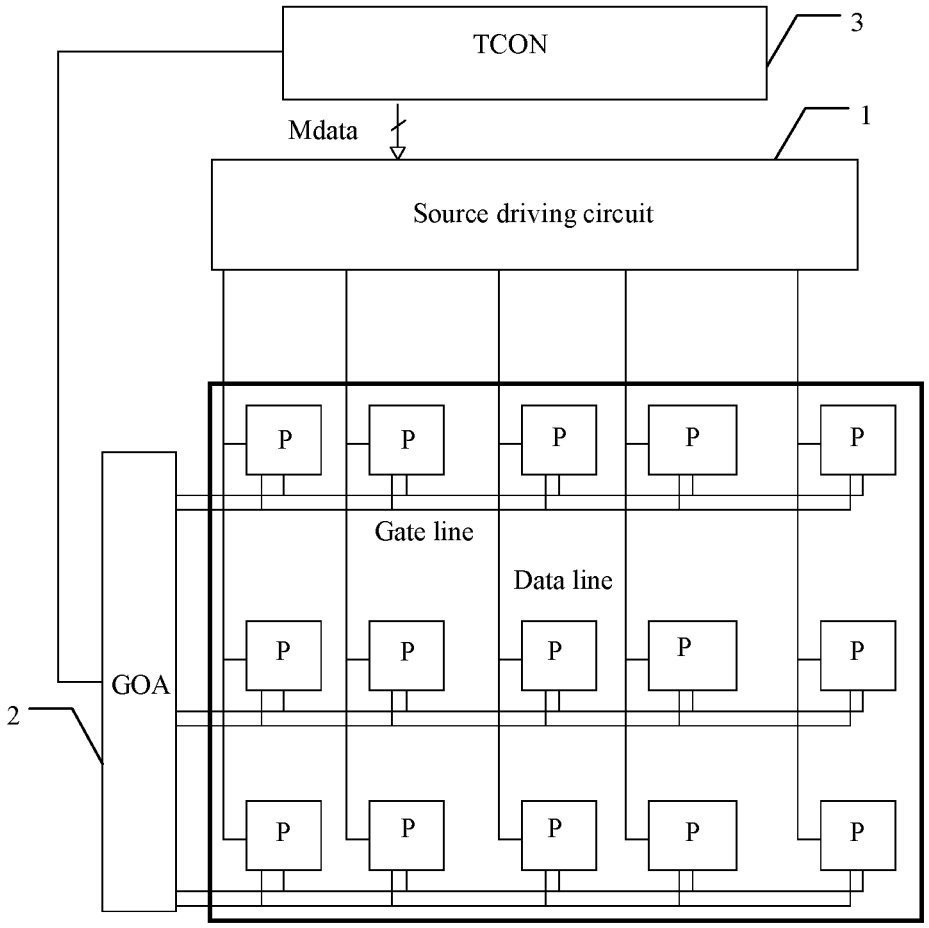
FIG. 1 (Prior Art)
FIG. 1 is a schematic structural diagram of a display panel in the related art.

Exemplary embodiments will now be described more fully with reference to the accompanying drawings. However, the exemplary embodiments may be embodied in a variety of forms and should not be construed as being limited to the embodiments set forth herein. On the contrary, the embodiments are provided to make the present disclosure comprehensive and through and to fully convey the concept of the exemplary embodiments to those skilled in the art. The same reference signs in the drawings denote the same or similar structures, and detailed descriptions thereof will be omitted.

Although terms having opposite meanings such as "up" and "down" are used herein to describe the relationship of one component relative to another component, such terms are used herein only for the sake of convenience, such as the directions illustrated in the accompanying drawings. It may be understood that if a device denoted in the drawings is turned upside down, a component described as "above" will become a component described as "under". Other words having opposite meanings such as "high" and "low", "top" and "bottom", or "left" and "right" shall be understood similarly. When a structure is described as "above" another structure, it probably means that the structure is integrally formed on another structure, or, the structure is "directly" disposed on another structure, or, the structure is "indirectly" disposed on another structure through an additional structure.

Words such as "one", "an/a", and "the" are used herein to indicate the presence of one or more elements/component parts/and others. Terms "including" and "having" have an inclusive meaning which means that there may be additional elements, component parts, and others in addition to the listed elements, component parts, and others.

The inventor of the present disclosure found that there is distributed capacitance in each column of data lines. When a source driving circuit inputs a data signal to a data line, it first needs to charge the distributed capacitance of the data line, and then charge a storage capacitance in the sub-pixel driving circuit. Generally, the capacitance of the storage capacitance in the sub-pixel driving circuit is less than 0.1 pF, but the distributed capacitance of the data line can reach tens of pF. Therefore, the process of writing data to the display screen by the source driver is equivalent to the process of writing to the data lines. When a voltage difference between two adjacent rows of data is relatively large, for example, the voltage difference corresponding to gray levels 0 and 255 is the largest, the source driver needs to output a largest amount of charge to fill a voltage change of the data line. On the other hand, due to requirements for high-quality display screen from users, a higher refresh rate is required, for example, it needs to be increased from 60 Hz to 90 Hz or 120 Hz, which increases an output power writing to the data lines from the source driver. With the increase of power consumption, operating temperature of the source driver at a high refresh rate is very high, which may even affect normal operation of the source driver.

FIG. 1 is a schematic structural diagram of a display panel in the related art. As shown in FIG. 1, the display panel includes a plurality of sub-pixel units P arranged in an array. The display panel may include a plurality of data lines extending in a column direction, a plurality of scan lines extending in a row direction, a source driving circuit 1, a gate driving circuit 2, and a timing controller 3. Each data line is connected with the plurality of sub-pixel units P, and the timing controller 3 can input an initial data signal Mdata to the source driving circuit 1 to control the source driving circuit 1 to output data signals to the plurality of data lines, wherein the data signals may be used to drive sub-pixels. The gate driving circuit 2 can input scan signals to the sub-pixel units P row by row under the control of the timing controller 3, thereby controlling the sub-pixel units to be driven row by row.

However, each column of the data lines has distributed capacitance. When the source driving circuit 1 inputs a data signal to the data line, it first needs to charge the distributed capacitance of the data line, and then charge a storage capacitance in a sub-pixel driving circuit. Generally, capacitance of the storage capacitance in the sub-pixel driving circuit is less than 0.1 pF, but the distributed capacitance of the data line can reach several tens of pF. Therefore, charging the distributed capacitance of the data lines greatly increases the power consumption of the source driving circuit.

Figure 2:
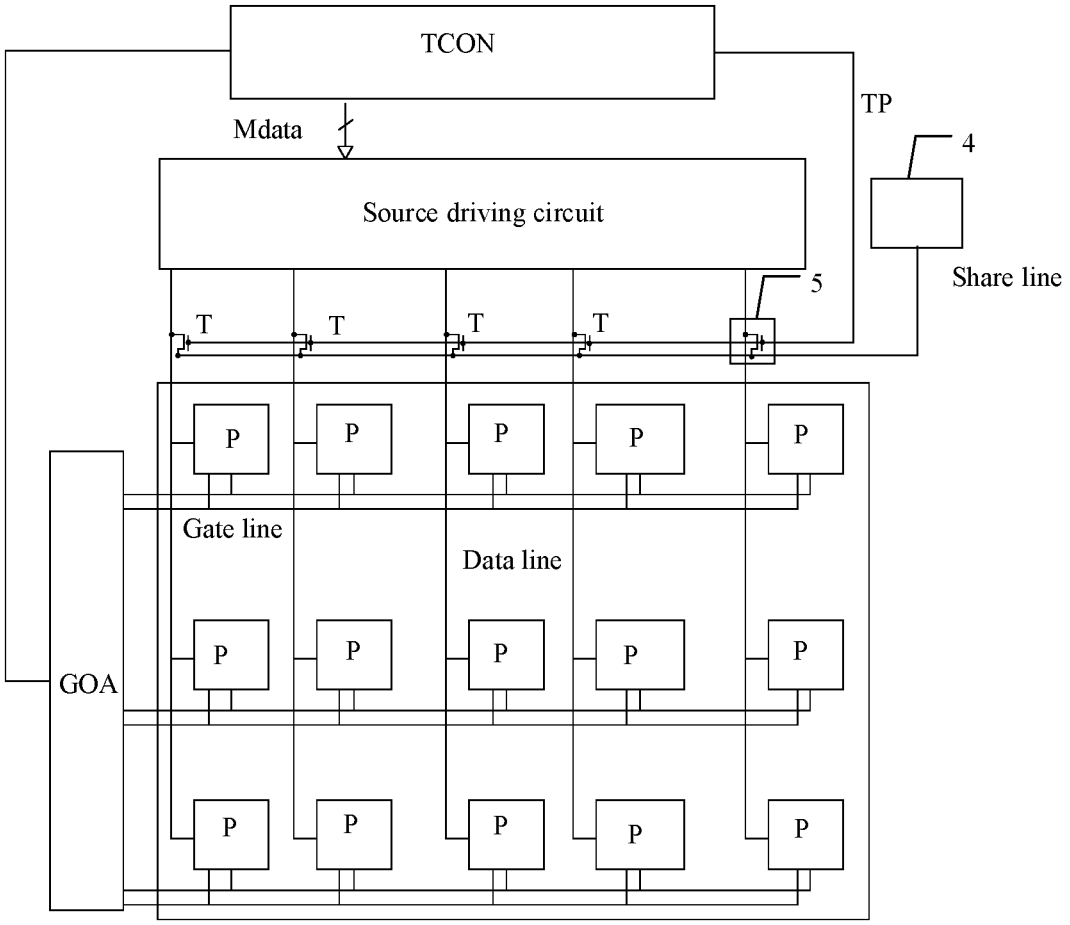
FIG. 2 is a schematic structural diagram of a driving circuit for a display panel according to an exemplary embodiment of the present disclosure.

Based on the above, this exemplary embodiment provides a driving circuit for a display panel. FIG. 2 is a schematic structural diagram of a display panel driving circuit according to an exemplary embodiment of the present disclosure. As shown in FIG. 2, the display panel includes a plurality of data lines, and the display panel driving circuit further includes a share line, a power supply circuit 4 and a plurality of switch units 5. The power supply circuit 4 may be any internal or external power supply that can provide a controllable voltage, for example, a power supply that can provide a voltage of 1.5V on a flexible circuit board. The share line is coupled to the plurality of data lines. The power supply circuit 4 is connected to the share line, and is configured to provide a share voltage to the share line. The plurality of switch units 5 are arranged in a one-to-one correspondence with the plurality of data lines. Each of the switch units 5 has a first end coupled to the share line and a second end coupled to one corresponding data line. The switch units 5 are configured to: in a share phase, connect with the plurality of data lines and transmit the share voltage on the share line to the data lines in response to a control signal TP. Here, the item "coupled" includes a direct connection, an electrical connection, or a signal connection.

This exemplary embodiment provides a driving circuit for a display panel, wherein the display panel includes a plurality of data lines, and the driving circuit for the display panel includes: a share line, a power supply circuit, and a plurality of switch units. The share line is connected to the plurality of data lines through the plurality of switch units. The power supply circuit is connected to the share line and is configured to provide a share voltage to the share line. The plurality of switch units are arranged in a one-to-one correspondence with the plurality of data lines, and each of the switch units has a first end coupled to the share line and a second end coupled to the corresponding one of the data lines. The switch units configured to: in a share phase, connect the plurality of data lines and transmit the share voltage on the share line to the data lines in response to a control signal. The driving circuit for the display panel provided by the present disclosure connects the plurality of data lines during the share phase to neutralize charges on the data lines to an average voltage, and the share voltage can reduce voltage variation amplitudes of the data lines in a driving phase. On one hand, the driving circuit of the display panel may not only reduce power consumption of the source driving circuit but also reduce time taken for charging the sub-pixel units by the source driving circuit; on the other hand, the present disclosure neutralizes the charges among the plurality of data lines by connecting the data lines in the share phase, thus avoiding the share line from inputting charges to each of the data lines to make its voltage reach a preset voltage, thereby reducing the power consumption of the power supply circuit.

In this exemplary embodiment, the plurality of switch units 5 may be switch transistors T, and each of the switch transistors T has a first end coupled to the share line, a second end coupled to one corresponding data line, and a control end configured to receive the control signal. The switch transistor may be either an N-type transistor or a P-type transistor. Description is made by taking an N-type transistor as an example in this exemplary embodiment.

Figure 3:
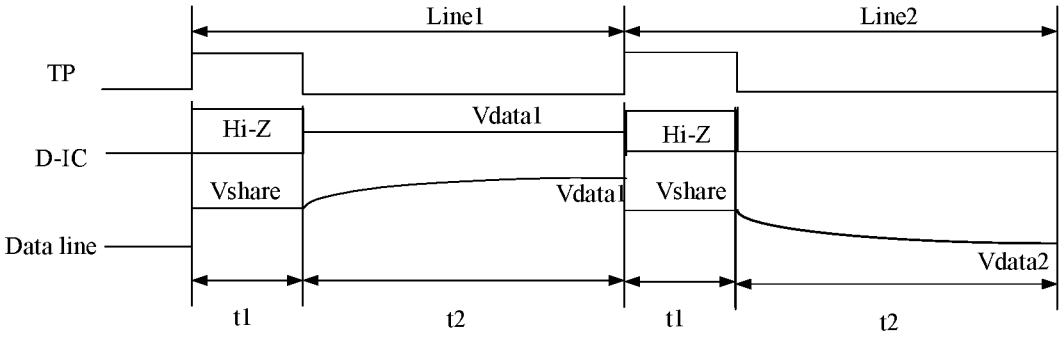
FIG. 3 is a control timing diagram of a driving circuit for a display panel according to an exemplary embodiment of the present disclosure.

FIG. 3 is a control timing diagram of a driving circuit for a display panel according to an exemplary embodiment of the present disclosure. FIG. 3 is a timing diagram illustrating adjacent pixel lines, line 1 and line 2. As shown in FIG. 3, TP represents a timing of a control signal, D-IC represents signal a timing of an output end of a source driving circuit, and "Data line" represents a timing of signals on the data lines. The above-mentioned timings of the driving circuit for the display panel, for driving the sub-pixel units in a same row, respectively include two phases: a share phase t1 and a driving phase t2. The share phase t1 and the driving phase t2, together with load of the data line (that is, resistance Rdata on the data line and capacitance Cdata on the data line) are arranged in balance, wherein a principle of the balance is to maximize a length of the share phase t1 under premise of ensuring validity of a signal on the data line.

In a first pixel line, line1:

In the share phase t1: before entering this phase t1, an output end D-IC of the source driving circuit is in a high-impedance state Hi-Z, that is, the source driving circuit is disconnected from the data line, and voltage on the data line is V0. Upon entering the phase t1, the control signal TP is at a high level, and the high-level signal turns on the switch transistor T to transmit the share voltage on the share line to the data line. At this time, voltage of the data line is Vshare.

In the driving phase t2: the signal TP is at low level, the switch transistor T is turned off under the action of the low level, the output end D-IC of the source driving circuit outputs a data signal Vdata1, and the data line changes from Vshare to Vdata1 under the action of the data signal Vdata1. Since most cases are |Vdata1−V0|>|Vdata1−Vshare|, the share voltage reduces a voltage variation amplitude of the data line in the driving phase.

In a second pixel line, line2:

In the share phase t1: before entering this phase t1, an output end D-IC of the source driving circuit is in a high-impedance state Hi-Z, that is, the source driving circuit is disconnected from the data line, and voltage on the data line is Vdata1 at this time. Upon entering this phase t1, the control signal TP is at a high level, and the high level signal turns on the switch transistor T to transmit the share voltage on the share line to the data line. At this time, the voltage of the data line is Vshare.

In the driving phase t2: the signal TP is at a low level, the switch transistor T is turned off under the action of the low level, the output end D-IC of the source driving circuit outputs a data signal Vdata2, and the data line changes from Vshare to Vdata2 under the action of the data signal Vdata2. Since most cases are |Vdata1−Vdata2|>|Vshare−Vdata2|, the share voltage reduces a voltage variation amplitude of the data line in the driving phase.

Figure 4:
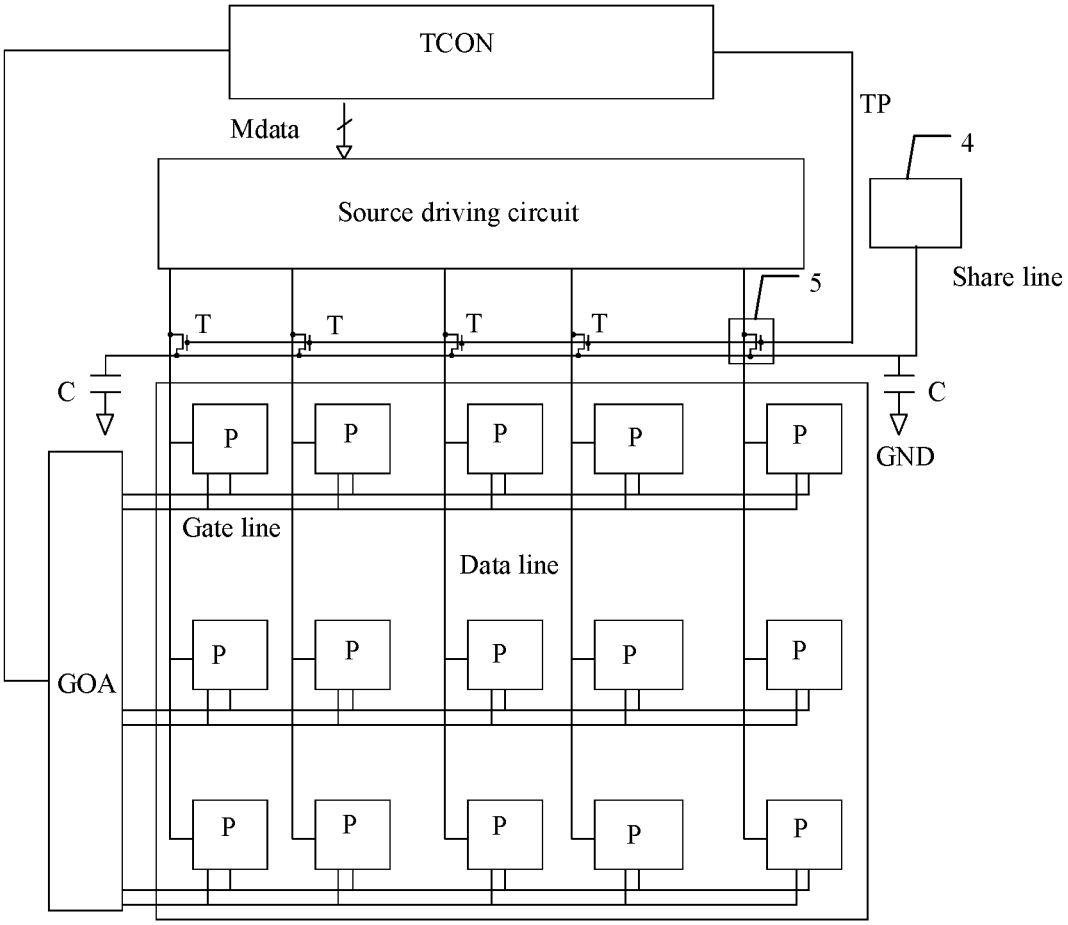
FIG. 4 is a schematic structural diagram of a driving circuit for a display panel according to another exemplary embodiment of the present disclosure.

In this exemplary embodiment, FIG. 4 is a schematic structural diagram of a driving circuit for a display panel according to another exemplary embodiment of the present disclosure. As shown in FIG. 4, the driving circuit for the display panel may further include at least one share capacitance C connected between the share line and a reference voltage end, such as, the ground end GND. For example, there are two share capacitors C, which may be respectively arranged at both ends of the share line. For example, if the data lines include a total of N data lines arranged side by side along a direction of the share line, a first share capacitor is disposed at a coupling position of the share line and the first data line, and a second share capacitor is disposed at a coupling position of the share line and the N-th data line. On the one hand, during a share phase of the sub-pixel units of a certain row, the share capacitor C can collect charges stored on the data line of the sub-pixel units of a previous row during the driving phase, thereby reducing the power consumption of a share circuit; on the other hand, the share capacitor C with charges stored therein can directly charge the data line during the share phase of the certain row, thereby reducing the charging time of the share phase. The two share capacitors are respectively arranged at both ends of the share line to reduce voltage loss caused by resistance of the data line when the share capacitor charges to the data line. It should be understood that, in other exemplary embodiments, the number of the share capacitors C may be differently set, and the share capacitors may be distributed in other ways, for example, a plurality of share capacitors are distributed in the share line at equal intervals, which falls into the protection scope of this disclosure.

Figure 5:
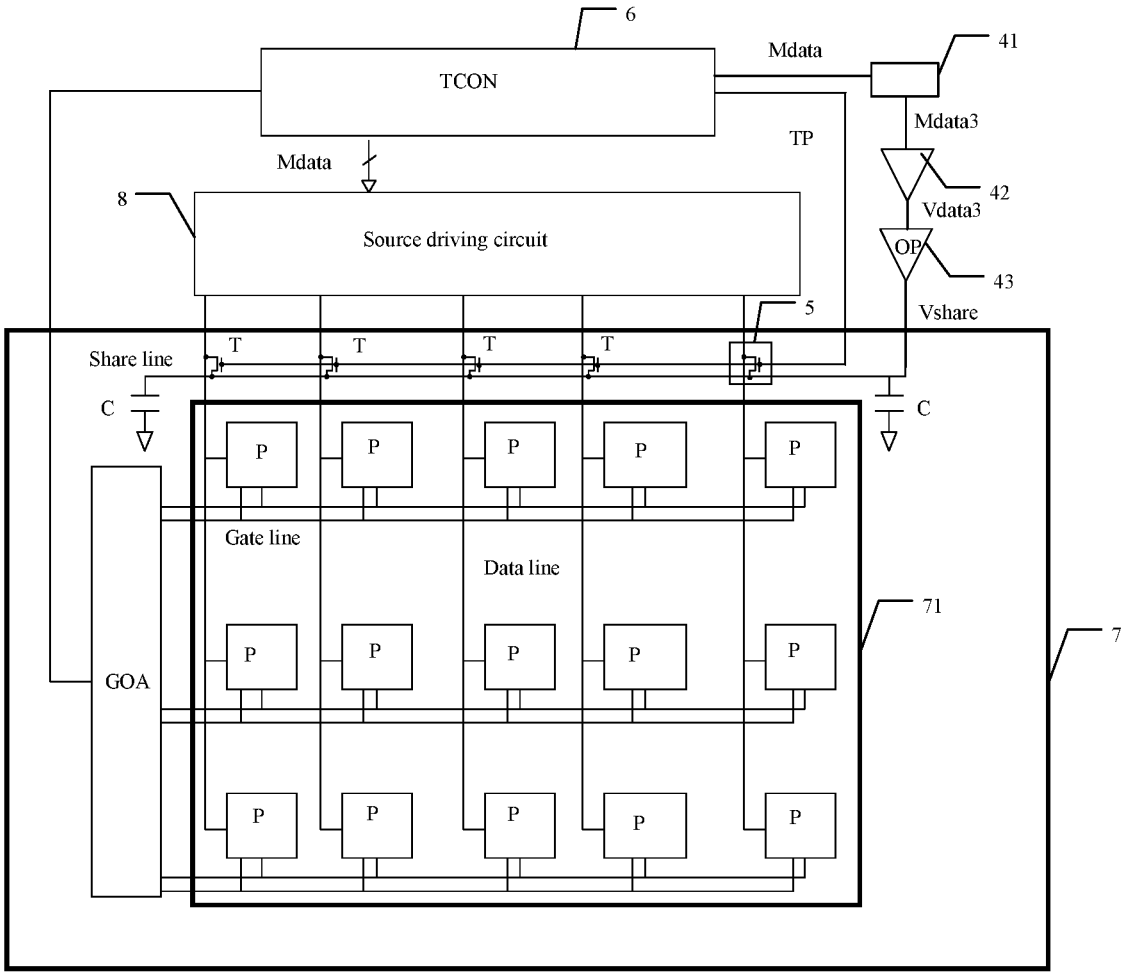
FIG. 5 is a schematic structural diagram a driving circuit for a display panel according to another exemplary embodiment of the present disclosure.

In this exemplary embodiment, FIG. 5 is a schematic structural diagram of a driving circuit for a display panel according to another exemplary embodiment of the present disclosure. As shown in FIG. 5, the display panel may include a timing controller 6. The power supply circuit 4 may include an averaging sub-circuit 41, a digital-to-analog converter 42 and an amplifier 43. The averaging sub-circuit 41 is coupled to the timing controller 6 and is configured to receive a plurality of initial data signals Mdata output by the timing controller 6 for driving sub-pixel units in a same row, to obtain an average data signal Mdata3 according to the plurality of initial data signals Mdata. The average data signal Mdata3 is equal to an average of the plurality of initial data signals Mdata. The digital-to-analog converter 42 is coupled to the averaging sub-circuit 41, and is configured to convert the average data signal Mdata3 into an average analog voltage Vdata3. The amplifier 43 is coupled to the digital-to-analog converter 42 and is configured to amplify the average analog voltage Vdata3 into the share voltage Vshare. The share voltage Vshare is equal to an average of the driving voltages corresponding to the sub-pixel units in the same row, for example, is an arithmetic average. Since the power supply circuit provided by this exemplary embodiment can set the share voltage Vshare to be a variable voltage, and the share voltage Vshare is equal to the average of the driving voltages corresponding to the sub-pixel units in the same row, thereby greatly reducing the power consumption of the source driving circuit. The averaging sub-circuit 41 may be integrated in the timing controller 6 as well, and may be a hardware circuit or a device consisting of software and hardware. It should be understood that in other exemplary embodiments, the power supply circuit 4 may have more structures for choice, all of which fall within the protection scope of the present disclosure.

In this exemplary embodiment, the display panel may include a timing controller 6 and a source driving circuit 8. The timing controller 6 and the source driving circuit 8 include clock signals for row-by-row scanning of sub-pixel units. The control signal TP may be controlled by the timing controller according to an output timing of the source driving circuit based on the clock signal, or the control signal TP may be generated by the source driving circuit.

In this exemplary embodiment, as shown in FIG. 5, a display panel 7 includes a display area 71 and an edge wiring area surrounding the display area. The above-mentioned switch unit, share line, and power supply circuit may be arranged in the edge wiring area. It should be understood that, in other exemplary embodiments, the switch unit, the share line, and the power supply circuit may also be arranged in other positions. For example, the switch unit, the share line, and the power supply circuit may be integrated in the source driving circuit 8, all of which fall into the protection scope of the present disclosure.

As an embodiment, the share line and the switch units connected to the data lines can be placed in the source driving circuit as well. Under the control of the timing controller, a TP signal is generated in the source driving circuit to control all data lines to be charged to a reference level Vshare before the data signal Vdata is output.

Figure 6:
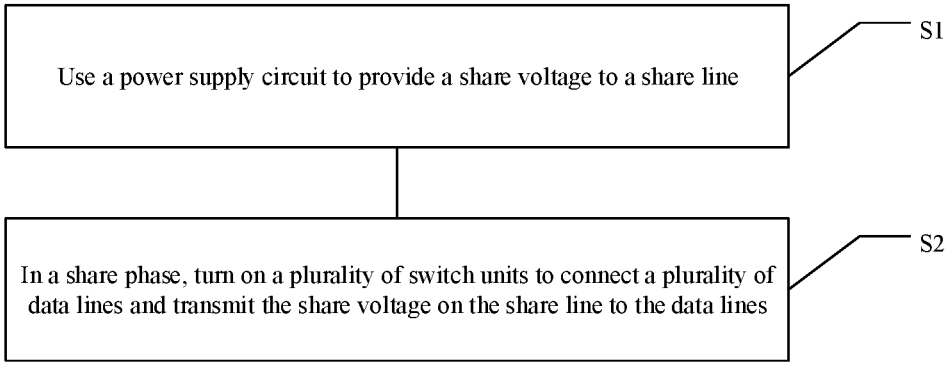
FIG. 6 is a flowchart of a display panel driving method according to an exemplary embodiment of the present disclosure.

This exemplary embodiment further provides a driving method for a display panel, which is used for driving the above-mentioned driving circuit for the display panel. FIG. 6 is a flowchart showing a method for driving a display panel according to an exemplary embodiment of the present disclosure. As shown in FIG. 6, the method includes the following steps:

In step S1, a power supply circuit is used to provide a share voltage to a share line.

In step S2, in a share phase, a plurality of switch units are turned on to connect a plurality of data lines and the share voltage on the share line is transmitted to the data lines.

In this exemplary embodiment, the share voltage is equal to an average of driving voltages corresponding to the sub-pixel units in a same row.

The exemplary embodiment provides a driving method for a display panel, which has the same technical features and working principles as those of the above-described driving circuit for the display panel. The above contents have been described in detail and will not be repeated here.

According to an aspect of the present disclosure, there is provided a display panel including the above-mentioned driving circuit for the display panel.

In this exemplary embodiment, the display panel may include an integrated circuit area for providing the source driving circuit and an edge wiring area surrounding the display area. The driving circuit for the display panel may be integrated in the integrated circuit area; or the driving circuit for the display panel may be integrated in the edge wiring area.

This exemplary embodiment provides a display panel, which has the same technical features and working principles as those of the above-mentioned driving circuit for a display panel. The above contents have been described in detail and will not be repeated here.

Other embodiments of the invention will be apparent to those skilled in the art from consideration of the specification and practice of the invention disclosed here. This application is intended to cover any variations, uses, or adaptations of the invention following the general principles thereof and including such departures from the present disclosure as come within known or customary practice in the art. It is intended that the specification and examples be considered as exemplary only, with a true scope and spirit of the invention being indicated by the following claims.

It will be appreciated that the present disclosure is not limited to the exact construction that has been described above and illustrated in the accompanying drawings, and that various modifications and changes may be made without departing from the scope thereof. It is intended that the scope of the invention only be limited by the appended claims.

What is claimed is:

1. A driving circuit for a display panel, wherein the display panel comprises a plurality of data lines, and the driving circuit for the display panel comprises:

a share line coupled to the plurality of data lines;

a power supply circuit connected to the share line, and configured to provide a share voltage to the share line;

a plurality of switch units coupled to the plurality of data lines, wherein each of the switch units has a first end coupled to the share line and a second end coupled to a corresponding one of the data lines, and the plurality of switch units are configured to, in a share phase, connect the plurality of data lines and transmit the share voltage on the share line to the data lines in response to a control signal; and a timing controller, wherein the power supply circuit comprises:

an averaging sub-circuit coupled to the timing controller, and configured to receive a plurality of initial data signals output by the timing controller, for driving sub-pixel units in a same row, to obtain an average data signal according to the plurality of initial data signals;

a digital-to-analog converter coupled to the averaging sub-circuit, and configured to convert the average data signal into an average analog voltage; and an amplifier coupled to the digital-to-analog converter, and configured to amplify the average analog voltage into the share voltage, wherein the average data signal is equal to an average of the plurality of initial data signals, and the share voltage is equal to an average of driving voltages corresponding to the sub-pixel units in the same row.

2. The driving circuit for the display panel according to claim 1, further comprising: at least one share capacitor, connected between the share line and a reference voltage end.

3. The driving circuit for the display panel according to claim 2, wherein, a number of the at least one share capacitor is two, and the share capacitors are a first capacitor and a second capacitor, wherein, if the plurality of data lines comprise a total of N data lines arranged side by side along a direction of the share line, the first share capacitor is provided at a coupling position of the share line and the first data line, and a second share capacitor is provided at a coupling position of the share line and the N-th data line.

4. The driving circuit for the display panel according to claim 1, wherein each of the plurality of switch units is a switch transistor, and the switch transistor has a first end coupled to the share line, a second end coupled to a corresponding one of the data lines, and a control end configured to receive the control signal.

5. The driving circuit for the display panel according to claim 1, further comprising: a source driving circuit, wherein the control signal is controlled by the timing controller according to an output timing of the source driving circuit.

6. The driving circuit for the display panel according to claim 1, further comprising: a source driving circuit, wherein the share line and the switch unit are placed inside the source driving circuit, and the control signal is generated by the source driving circuit under a control of the timing controller.

7. A driving method for a display panel for driving a driving circuit for the display panel, comprising:

providing the display panel, wherein the display panel comprises a plurality of data lines;

providing the driving circuit for the display panel, wherein the driving circuit comprises:

a share line coupled to the plurality of data lines;

a power supply circuit connected to the share line, and configured to provide a share voltage to the share line;

a plurality of switch units coupled to the plurality of data lines, wherein each of the switch units has a first end coupled to the share line and a second end coupled to a corresponding one of the data lines, and the plurality of switch units are configured to, in a share phase, connect the plurality of data lines and transmit the share voltage on the share line to the data lines in response to a control signal; and a timing controller;

wherein the power supply circuit comprises:

an averaging sub-circuit coupled to the timing controller, and configured to receive a plurality of initial data signals output by the timing controller, for driving sub-pixel units in a same row, to obtain an average data signal according to the plurality of initial data signals;

a digital-to-analog converter coupled to the averaging sub-circuit, and configured to convert the average data signal into an average analog voltage; and an amplifier coupled to the digital-to-analog converter, and configured to amplify the average analog voltage into the share voltage, wherein the average data signal is equal to an average of the plurality of initial data signals, and the share voltage is equal to an average of driving voltages corresponding to the sub-pixel units in the same row;

providing the share voltage to the share line with the power supply circuit; and in the share phase, turning on the plurality of switch units to connect the plurality of data lines and transmitting the share voltage on the share line to the data lines.

8. The driving method for the display panel according to claim 7, wherein the driving circuit for the display panel further comprises: a source driving circuit, wherein the control signal is controlled by the timing controller according to an output timing of the source driving circuit.

9. The driving method for the display panel according to claim 7, wherein the driving circuit for the display panel further comprises: a source driving circuit, wherein the share line and the switch unit are placed inside the source driving circuit, and the control signal is generated by the source driving circuit under a control of the timing controller.

10. A display panel comprising a driving circuit for a display panel, wherein the display panel comprises a plurality of data lines, and the driving circuit for the display panel comprises:

a share line coupled to the plurality of data lines;

a power supply circuit connected to the share line, and configured to provide a share voltage to the share line;

a plurality of switch units coupled to the plurality of data lines, wherein each of the switch units has a first end coupled to the share line and a second end coupled to a corresponding one of the data lines, and the plurality of switch units are configured to, in a share phase, connect the plurality of data lines and transmit the share voltage on the share line to the data lines in response to a control signal; and a timing controller;

wherein the power supply circuit comprises:

an averaging sub-circuit coupled to the timing controller, and configured to receive a plurality of initial data signals output by the timing controller, for driving sub-pixel units in a same row, to obtain an average data signal according to the plurality of initial data signals;

a digital-to-analog converter coupled to the averaging sub-circuit, and configured to convert the average data signal into an average analog voltage; and an amplifier coupled to the digital-to-analog converter, and configured to amplify the average analog voltage into the share voltage, wherein the average data signal is equal to an average of the plurality of initial data signals, and the share voltage is equal to an average of driving voltages corresponding to the sub-pixel units in the same row.

11. The display panel according to claim 10, wherein the driving circuit for the display panel further comprises: at least one share capacitor connected between the share line and a reference voltage end.

12. The display panel according to claim 11, wherein:

a number of the at least one share capacitor is two, and the share capacitors are a first capacitor and a second capacitor, wherein, if the plurality of data lines comprise a total of N data lines arranged side by side along a direction of the share line, the first share capacitor is provided at a coupling position of the share line and the first data line, and a second share capacitor is provided at a coupling position of the share line and the N-th data line.

13. The display panel according to claim 10, wherein each of the plurality of switch units is a switch transistor, and the switch transistor has a first end coupled to the share line, a second end coupled to a corresponding one of the data lines, and a control end configured to receive the control signal.

14. The display panel according to claim 10, wherein the driving circuit for the display panel further comprises: a source driving circuit, wherein the control signal is controlled by the timing controller according to an output timing of the source driving circuit.

15. The display panel according to claim 10, wherein the driving circuit for the display panel further comprises: a source driving circuit, wherein the share line and the switch unit are placed inside the source driving circuit, and the control signal is generated by the source driving circuit under a control of the timing controller.

* * * * *